US005400127A

United States Patent [19]

Arai et al.

[11] Patent Number: 5,400,127

[45] Date of Patent: Mar. 21, 1995

[54] TONER RECOVERY SYSTEM WHICH DETECTS LINEAR MOVEMENT OF A RECOVERED TONER TRANSPORTER

[75] Inventors: Makoto Arai, Tokyo; Yasushi Koichi, Yamato; Toshitaka Yamaguchi, Niiza; Yoshiyuki Tanimoto, Tokyo, all of Japan

[73] Assignee: Ricoh Company, Ltd., Tokyo, Japan

[21] Appl. No.: 156,828

[22] Filed: Nov. 24, 1993

[30] Foreign Application Priority Data

Nov. 26, 1992 [JP] Japan ..... 4-317154

[51] Int. Cl.[6] ..... G03G 21/00

[52] U.S. Cl. ..... 355/298

[58] Field of Search ..... 355/296, 298

[56] References Cited

U.S. PATENT DOCUMENTS

| | | | |
|---|---|---|---|
| 4,218,126 | 8/1980 | Takeichi | 355/298 |
| 4,436,414 | 3/1984 | Kamiyama et al. | 355/298 |
| 4,868,599 | 9/1989 | Niki | 355/298 X |
| 4,885,612 | 12/1989 | Satoh et al. | 355/305 |
| 4,982,230 | 1/1991 | Ogura et al. | 355/298 X |
| 4,982,231 | 1/1991 | Matsuuchi | 355/298 X |
| 4,989,048 | 1/1991 | Arai et al. | 355/299 |
| 5,113,227 | 5/1992 | Miyasaka | 355/298 |
| 5,268,720 | 12/1993 | Saitoh et al. | 355/298 X |

*Primary Examiner*—Fred L. Braun

*Attorney, Agent, or Firm*—Oblon, Spivak, McClelland, Maier & Neustadt

[57] ABSTRACT

A toner recovery system is adapted to an image forming apparatus which carries out an image forming operation to form prints of a toner image on a photosensitive body using a toner. The toner recovery system includes a toner recovery unit for recovering the toner which remains on the photosensitive body after the image forming operation for each print, a recovered toner tank for accommodating the toner recovered by the toner recovery unit, a transport unit for transporting the toner recovered by the toner recovery unit to the recovered toner tank by moving in a first direction with a first force, a detector for detecting a movement of the transport unit in a second direction which is opposite to the first direction caused by an overflow of the recovered toner in the recovered toner tank, and a control circuit for controlling the transport unit to transport the recovered toner by moving in the first direction with a second force which is greater than the first force if the detector detects the movement of the transport unit in the second direction.

13 Claims, 5 Drawing Sheets

TONER RECOVERY SYSTEM WHICH DETECTS LINEAR MOVEMENT OF A RECOVERED TONER TRANSPORTER

BACKGROUND OF THE INVENTION

The present invention generally relates to toner recovery systems, and more particularly to a toner recovery system for an image forming apparatus.

Conventionally, various toner recovery systems have been proposed for an image forming apparatus such as a copying machine. For example, there is a toner recovery system which is provided with a means for detecting a full state of a recovered toner tank by detecting a lowered position of the recovered toner tank due to the weight of the recovered toner. On the other hand, there is a toner recovery system which is provided with a detection means for detecting the full state of the recovered toner tank in response to a pushing force of a toner recovering member which is pushed by the toner which cannot be transported to the recovered toner tank due to the full state of the recovered toner tank. The "recovered toner" refers to the residual toner which remains on a photosensitive drum or the like after a toner image on the photosensitive drum is transferred onto a recording sheet and is recovered when the photosensitive drum is cleaned by known means.

According to the toner recovery systems described above, the image forming apparatus suddenly stops the image forming operation such as a copying operation without any advance notice when the recovered toner tank becomes full. In addition, when extracting the recovered toner tank from the image forming apparatus, there was a problem in that the toner within the recovered toner tank easily overflows from the recovered toner tank and contaminates the inside of the image forming apparatus.

SUMMARY OF THE INVENTION

Accordingly, it is a general object of the present invention to provide a novel and useful toner recovery system in which the problems described above are eliminated.

Another and more specific object of the present invention is to provide a toner recovery system for an image forming apparatus which carries out an image forming operation to form prints of a toner image on a photosensitive body using a toner, comprising toner recovery means for recovering the toner which remains on the photosensitive body after the image forming operation for each print, a recovered toner tank for accommodating the toner recovered by the toner recovery means, transport means for transporting the toner recovered by the toner recovery means to the recovered toner tank by moving in a first direction with a first force, first detection means for detecting a movement of the transport means in a second direction which is opposite to the first direction caused by an overflow of the recovered toner in the recovered toner tank, and control means, coupled to the first detection means, for controlling the transport means to transport the recovered toner by moving in the first direction with a second force which is greater than the first force if the first detection means detects the movement of the transport means in the second direction. According to the toner recovery system of the present invention, the toner is forced into the recovered toner tank when the full state of the recovered toner tank is detected, so that a predetermined number of prints can be made and a sudden stop of the image forming operation is prevented.

Still another object of the present invention is to provide the toner recovery system of the above described type which further comprises alarm means, coupled to the control means, for outputting an alarm if the first detection means detects the movement of the transport means in the second direction. According to the toner recovery system of the present invention, it is possible to alarm operator of the full state of the recovered toner tank by an advance notice.

A further object of the present invention is to provide the toner recovery system of the type described first above, which further comprises counter means for counting a number of prints formed, and stop means for stopping the image forming operation when activated, where the control means activates the stop means if the first detection means detects the movement of the transport means in the second direction and the counter means thereafter counts up to a predetermined counted value. According to the toner recovery system of the present invention, it is possible to prevent a sudden stop of the image forming operation and to prevent an overflow of the toner from the recovered toner tank.

Another object of the present invention is to provide the toner recovery system of the type described first above, which further comprises removal detection means for detecting removal of the recovered toner tank and for outputting a detection signal, where the control means deactivates the stop means and cancelling the movement of the transport means in the first direction with the second force in response to the detection signal if the removal detection means detects the removal of the recovered toner tank, and the control means activates the stop means if the first detection means detects the movement of the transport means in the second direction in a state where a counted value of the counter means is less than the predetermined counted value, and deactivates the stop means to resume the image forming operation if the first detection means detects no movement in the second direction when the counted value in the counter means is the predetermined counted value. According to the toner recovery system of the present invention, it is possible to prevent an erroneous operation of the image forming apparatus even if the recovered toner tank is loaded in error such as the case where the operator forgets to load the recovered toner tank.

Still another object of the present invention is to provide the toner recovery system of the type described first above, which further comprises second detection means for detecting the movement of the transport means in the second direction prior to the first detection means, where the control means increases the force of the transport means depending on a moving distance of the transport means in the second direction based on the detections of the first and second detection means. According to the toner recovery system of the present invention, it is possible to simplify the construction because no counter means is required.

Other objects and further features of the present invention will be apparent from the following detailed description when read in conjunction with the accompanying drawings.

DESCRIPTION OF THE PREFERRED EMBODIMENTS

Figure 1:
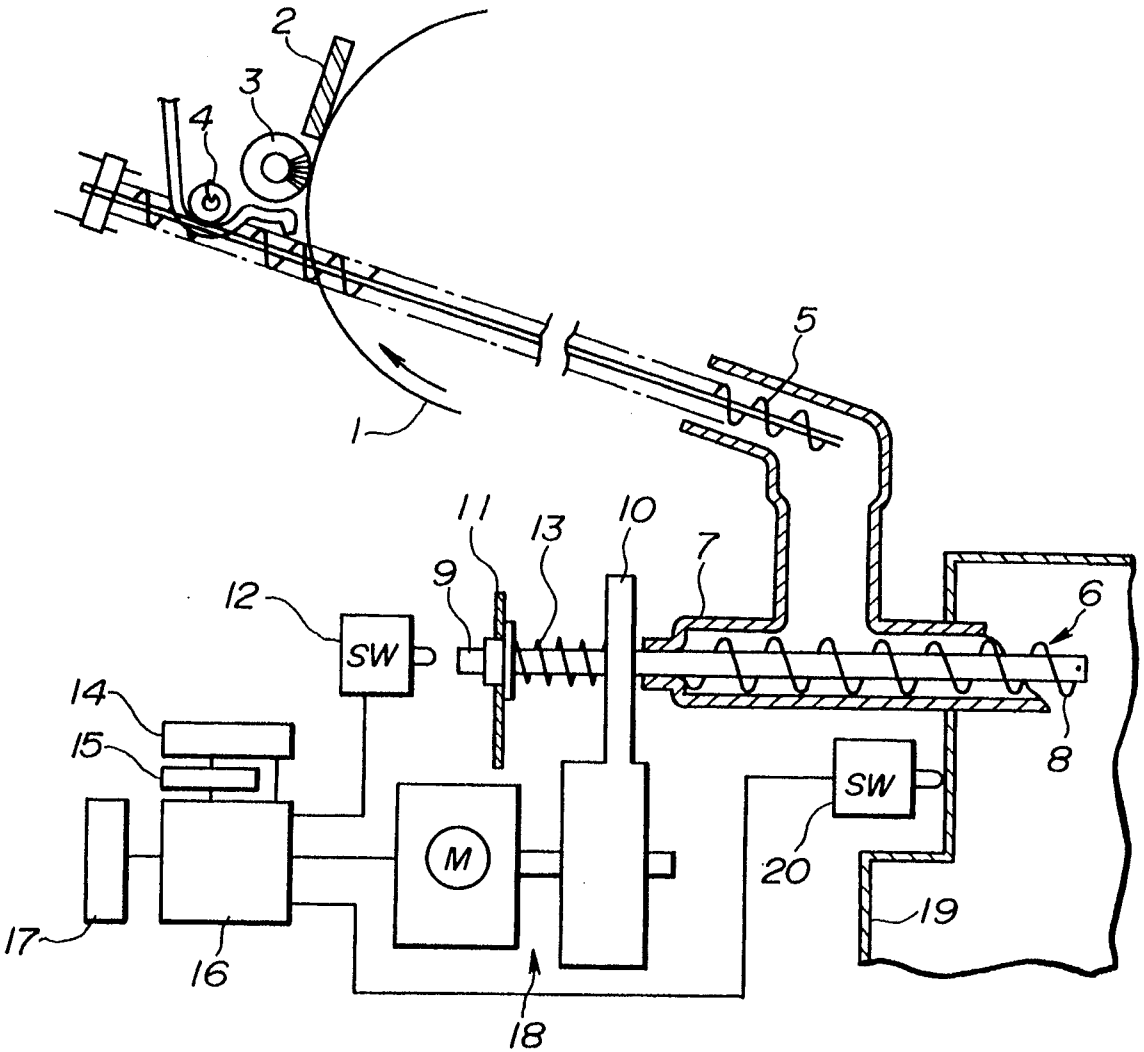
FIG. 1 is a diagram generally showing a vertical cross section of a first embodiment of a toner recovery system according to the present invention.

A description will be given of a first embodiment of a toner recovery system according to the present invention, by referring to FIGS. 1 and 2. FIG. 1 generally shows a vertical cross section of the first embodiment, and FIG. 2 generally shows a control circuit of the first embodiment.

In FIG. 1, an image forming part of an image forming apparatus includes a photosensitive (or photoconductive) drum 1, a cleaning blade 2, a cleaning brush 3, a toner ejection coil 4, and a toner transport coil 5. For example, the image forming apparatus is a copying machine, and an electrostatic image and a toner image are sequentially formed on an outer periphery of the photosensitive drum 1. On the other hand, a toner recovery unit 6 includes a rotary shaft 9, and a spiral rotary body 8 which is fit over the rotary shaft 9 and is movable within a toner recovery path 7. One end of the rotary shaft 9 projects outside the toner recovery path 7, and a stopper 11 is provided on the other end of the rotary shaft 9. The rotary shaft 7 is constantly urged in a transport direction by a spring 13 which is inserted between the stopper 11 and a support member 10 which is provided on a frame (not shown) of the image forming apparatus. A first movement detection switch 12 confronts a projecting end of the rotary shaft 9 and detects the movement of the rotary shaft 9 in a reverse direction. This first movement detection switch 12 is provided on the frame of the image forming apparatus.

Figure 2:
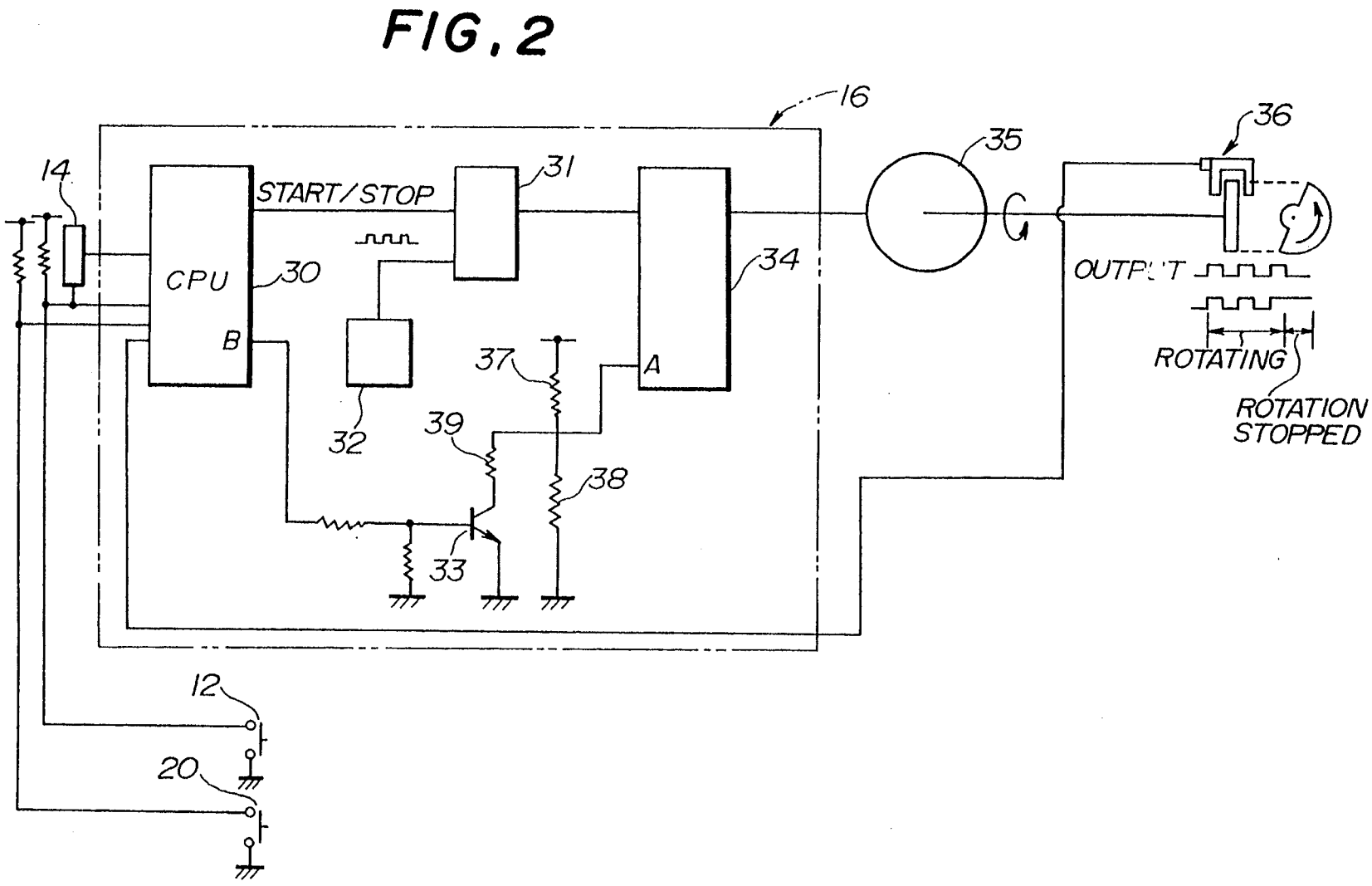
FIG. 2 is a system block diagram generally showing a control circuit of the first embodiment.

A detection output of the first movement detection switch 12 is supplied to a counter 14 and a control circuit 16 which includes a central processing unit (CPU) 30 shown in FIG. 2. An output of the counter 1.4 is supplied to a stopping circuit 15 and the control circuit 16. An output of the control circuit 16 is supplied to a display device 17, and a driving circuit 18 which drives the rotary shaft 9. In addition, an output of the stopping circuit 15 is supplied to the control circuit 16 so as to control the rotation of the rotary shaft 9.

A removal detection switch 20 for detecting the removal of a recovered toner tank 19 is provided on the frame of the image forming apparatus and makes contact with the recovered toner tank 19. A detection output of the removal detection switch 20 is supplied to the control circuit 16. Of course, this removal detection switch 19 and the first movement detection switch 12 need not necessarily be mechanical switches, and non-contacting position detection sensors may be used therefor.

In this embodiment, the recovered toner transported by the toner recovery unit 6 acts as a load when the recovered toner tank 19 becomes full. The rotary shaft 9 moves in the reverse direction in response to this load and turns the first movement detection switch 12 ON. When the first movement detection switch 12 turns ON, the control circuit 16 controls the driving circuit 18 to increase the rotational torque of the rotary shaft 9 from the state before the first movement detection switch 12 turned ON, in response to the detection output of the first movement detection switch 12 which is ON. By this increased rotational torque, an amount of the recovered toner sufficient to form a predetermined number of prints is forced into the recovered toner tank 19 by the rotation of the rotary shaft 9. As a result, the first movement detection switch 12 turns OFF, but in addition, the control circuit 16 makes a display on the display device 17 to indicate the full state of the recovered toner tank 19 as an advanced notice. Furthermore, the control circuit 16 starts a counting operation of the counter 14. When the counter 14 counts up to a predetermined counted value amounting to the predetermined number of prints, the stop circuit 15 controls the driving circuit 18 via the control circuit 16 so as to stop the image forming operation of the image forming apparatus in response to this predetermined counted value.

If the removal detection switch 20 detects that the operator of the image forming apparatus has 10 replaced the recovered toner tank 19, the detection output of the removal detection switch 20 controls the control circuit 16 so as to cancel the operations of stopping the image forming operation, increasing the rotational torque of the rotary shaft 9 and displaying the full state of the recovered toner tank 19 on the display device 17. In other words, the control circuit 16 controls the stop circuit 15 to stop the operation of stopping the image forming apparatus, controls the driving circuit 18 to stop the operation of increasing the rotational torque of the rotary shaft 9, and controls the display device 17 to stop the operation of displaying the full state of the recovered toner tank 19.

Thereafter, if the image forming operation is carried out and the first movement detection switch 12 detects the movement of the rotary shaft 9 in the reverse direction in a state where the number of prints counted in the counter 14 is less than the predetermined counted value, the stop circuit 15 stops the image forming operation. On the other hand, if the counter 14 counts up to the predetermined number but the first movement detection switch 12 does not detect the movement of the rotary shaft 9 in the reverse direction, the stop circuit 15 controls the control circuit 16 so as to return the operation of the image forming apparatus to the normal image forming operation, that is, the normal copying operation in the case where the image forming apparatus is the copying machine.

In this embodiment, the driving circuit 18 includes a stepping motor 35 shown in FIG. 2 and a torque transmission mechanism (not shown). The stepping motor 35 and the torque transmission mechanism are driven under the control of the CPU 30 within the control circuit 16.

In FIG. 2 which shows the control circuit 16 or a driving circuit for the stepping motor 35, the CPU 30 receives the detection outputs of the first movement detection switch 12 and the removal detection switch 20. A clock signal which is required to drive the stepping motor 35 is supplied from a timer integrated circuit (IC) 32 to a stepping motor control IC 31. This stepping motor control IC 31 outputs a driving pulse signal in response to a start signal from the CPU 30 and stops outputting the driving pulse signal in response to a stop signal from the CPU 30. The stepping-motor 35 is driven by the driving pulse signal which is received from the stepping motor control IC 31 via a stepping motor drive IC 34, and stops when no driving pulse signal is received.

For example, an IC chip TA8415P manufactured by Toshiba of Japan may be used for the stepping motor control IC 31, an IC chip M51848P manufactured by Mitsubishi of Japan may be used for the timer IC 32, and a chip SLA7024M manufactured by Sanken of Japan may be use for the stepping motor drive IC 34.

The stepping motor drive IC 34 drives the stepping motor 35 by a constant current. When a signal output from an output terminal B of the CPU 30 has a high level, a transistor 33 turns ON and a voltage which is divided by a combined resistance $R_2$38 and $R_3$39 and a resistance $R_1$37 is applied to an input terminal A of the stepping motor drive IC 34, where $R_2$38, $R_3$39 and $R_1$37 respectively denote the resistances of resistors 38, 39 and 37. On the other hand, when the signal output from the output terminal B of the CPU 30 has a low level, the transistor 33 turns OFF and a voltage which is divided by the resistances $R_1$37 and $R_2$38 is applied to the input terminal A of the stepping motor drive IC 34.

Accordingly, the voltage applied to the input terminal A of the stepping motor drive IC 34 when the signal from the output terminal B of the CPU 30 has the high level can be made smaller than that when the signal from the output terminal B has the low level, by appropriately selecting the resistances $R_2$38, $R_3$39 and $R_1$37. In other words, the current flowing through the stepping motor 35 can be made variable, so that it is possible to drive the stepping motor 35 at a high torque and at a low torque.

A photointerrupter unit 36 is provided on the rotary shaft of the stepping motor 35 so as to detect the rotation of this rotary shaft. An output of the photointerrupter 36 is supplied to the CPU 30. Hence, if the rotation of the rotary shaft of the stepping motor 35 makes an abnormal stop during rotation, the CPU 30 can stop the image forming operation in response to the output of the photointerrupter 36 indicating the abnormal state. As indicated under the photointerrupter 36 in FIG. 2, the output of the photointerrupter 36 is a pulse signal while the stepping motor 35 rotates. However, in the abnormal state where the stepping motor 35 stops, the output of the photointerrupter 36 becomes constant. Hence, the normal and abnormal states of the stepping motor 35 can be detected from the output of the photointerrupter 36.

Figure 3:
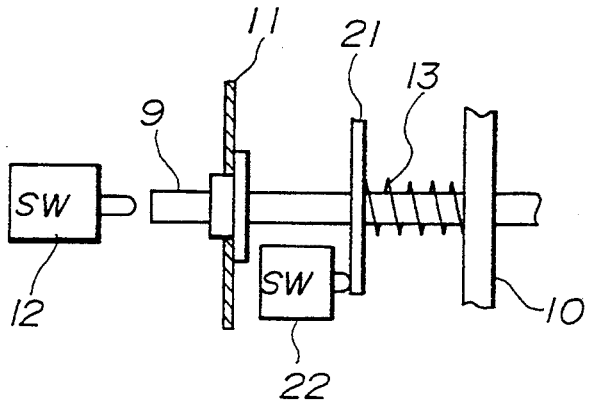
FIG. 3 is a diagram generally showing a vertical cross section of first and second movement detection switches of a second embodiment of the toner recovery system according to the present invention.

Next, a description will be given of a second embodiment of the toner recovery system according to the present invention, by referring to FIG. 3. FIG. 3 generally shows a vertical cross section of first and second movement detection switches of the second embodiment. In FIG. 3, those parts which are the same as those corresponding parts in FIG. 1 are designated by the same reference numerals, and a description thereof will be omitted.

In this embodiment, a pushing member 21 which pushes a contact point of a second movement detection switch 22 is provided between the stopper 11 and the support member 10. In addition, the spring 13 is inserted between the pushing member 21 and the support member 10. The second movement detection switch 22 is provided on the frame of the image forming apparatus and makes contact with the pushing member 21 to detect the movement of the toner recovery unit 6. The first and second movement detection switches 12 and 22 are arranged so that the second movement detection switch 22 turns ON first and the first movement detection switch 12 turns ON thereafter when the rotary shaft 9 moves. The outputs of the first and second movement detection switches 12 and 22 are supplied to the control circuit 16 (not shown in FIG. 3). Otherwise, this embodiment is the same as the first embodiment described above.

In this embodiment, when the second movement detection switch 22 detects the movement of the rotary shaft 9, the control circuit 16 displays the full state of the recovered toner tank 19 on the display device 17, and increases the driving torque supplied by the driving circuit 18 so as to continue the image forming operation. In addition, the control circuit 16 stops the image forming operation when the first movement detection switch 12 thereafter detects the movement of the rotary shaft 9. For this reason, there is no need to provide the counter 14 shown in FIG. 1.

Only one second movement detection switch 22 is provided in this embodiment, however, it is possible to provide a plurality of such second movement detection switches 22. In this case, the driving torque supplied by the driving circuit 18 can be increased in steps depending on the moving distance of the rotary shaft 9 in correspondence with the intervals at which the second movement detection switches 22 are arranged, thereby making it possible to display the full state of the recovered toner tank 19 in steps. That is, the closeness to the full state of the recovered toner tank 19 can be displayed in steps as an advance notice, and the image forming operation is stopped when one of the second movement detection switches 22 detects a final position of the rotary shaft 9.

As alternatives for providing a plurality of second movement detection switches 22, it is possible to employ a position sensor which detects a plurality of positions of the pushing member 21 or, to employ a timer and detect a plurality of positions of the pushing member based on the time lapsed from a reference position of the pushing member 21, for example.

Figure 4A:
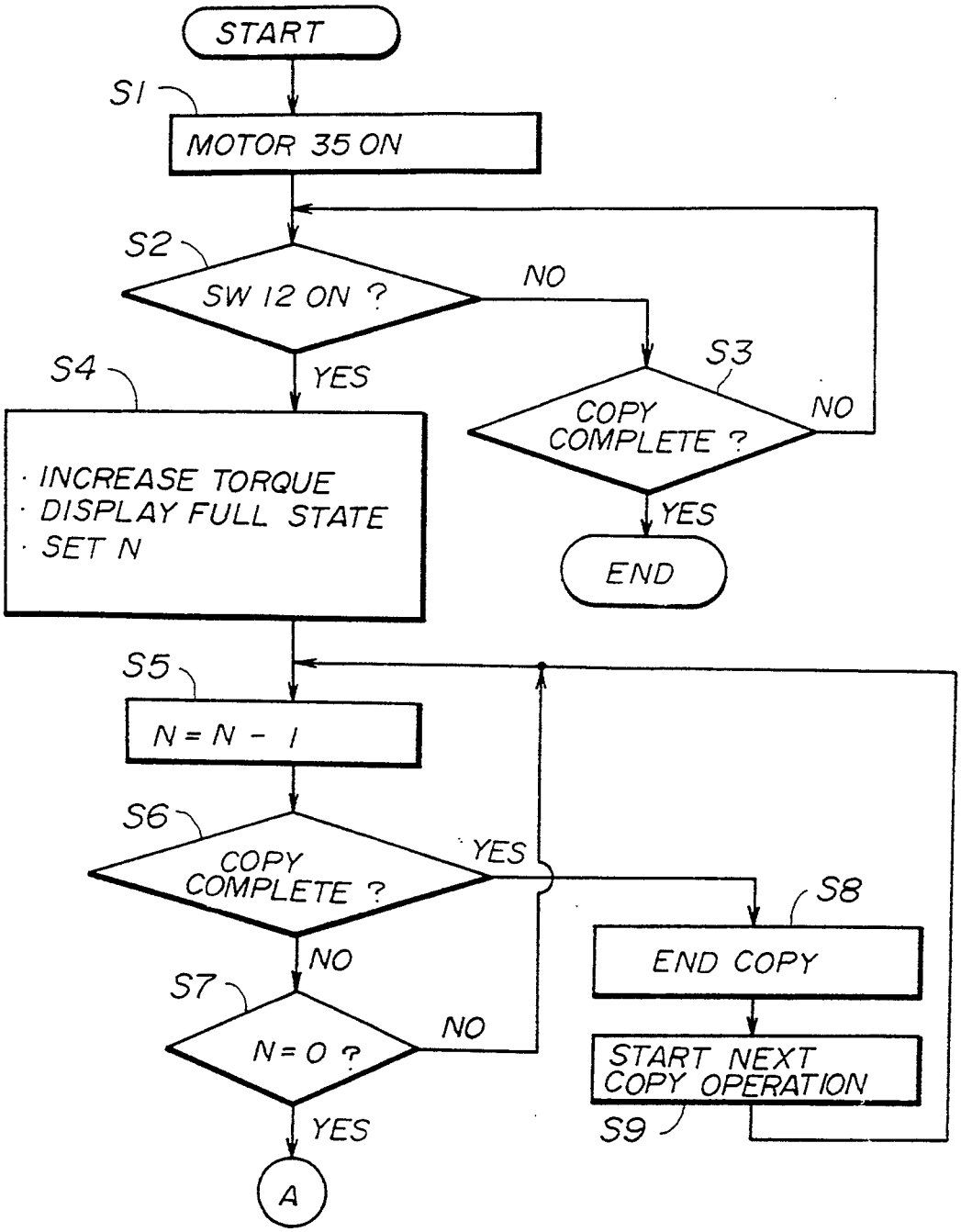
FIGS. 4A and 4B respectively are flow charts for explaining the operation of the control circuit of the first embodiment.
Figure 4B:
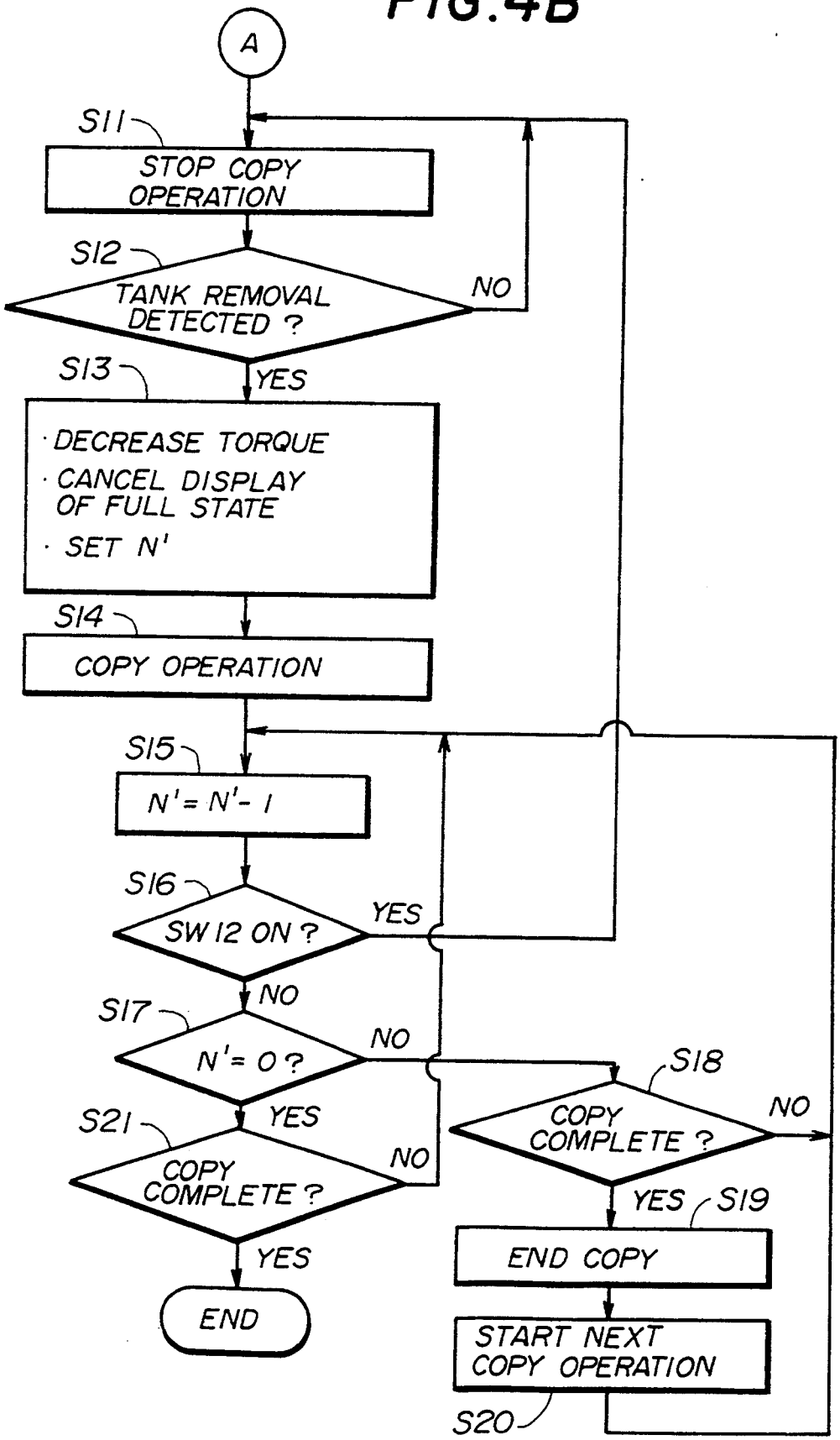

Next, a description will be given of the operation of the control circuit 16 shown in FIG. 2 of the first embodiment, by referring to FIGS. 4A and 4B. FIGS. 4A and 4B are flow charts showing the operation of the control circuit 16, that is, the processes of the CPU 30.

When a copying operation starts in FIG. 4A, a step S1 turns ON the stepping motor 35, and a step S2 decides whether or not the first movement detection switch 12 is ON. If the decision result in the step S2 is NO, a step S3 decides whether or not the copying operation is completed. The process returns to the step S2 if the decision result in the step S3 is NO, but the copying operation ends if the decision result in the step S3 is YES.

On the other hand, if the decision result in the step S2 is YES, a step S4 outputs a low-level signal from the terminal B of the CPU 30 to increase the torque of the stepping motor 35, displays the full state of the recovered toner tank 19 on the display device 17, and sets N to a predetermined number (of prints). A step S5 decrements N by 1, and a step S6 decides whether or not the copying operation is completed. If the decision result in the step S6 is NO, a step S7 decides whether or not N=0, and the process returns to the step S5 if the decision result in the step S7 is NO. Hence, N is successively decremented depending on the number of prints made.

If the decision result in the step S6 is YES, a step S8 ends the copying operation, and a step S9 starts a next copying operation.

The process advances to a step S11 shown in FIG. 4B if the decision result in the step S7 shown in FIG. 4A is YES. In FIG. 4B, the step S11 stops the copying operation, and a step S12 decides whether or not the recovered toner tank 19 has been removed and replaced. The process returns to the step S11 if the decision result in the step S12 is NO.

On the other hand, if the decision result in the step S12 is YES, a step S13 outputs a high-level signal from the terminal B of the CPU 30 to decrease the torque of the stepping motor 35, cancels the display of the full state of the recovered toner tank 19 on the display device 19, and sets N' to a predetermined number (of prints). A step S14 carries out the copying operation, and a step S15 decrements N' by 1. A step S16 decides whether or not the first movement detection switch 12 is ON, and the process returns to the step S11 if the decision result in the step S16 is YES.

If the decision result in the step S16 is NO, a step S17 decides whether or not N'=0. If the decision result in the step S17 is NO, a step S18 decides whether or not the copying operation is completed. The process returns to the step S15 if the decision result in the step S18 is NO. But if the decision result in the step S18 is YES, a step S19 ends the copying operation, and a step S20 starts a next copying operation. The process returns to the step S15 after the step S20.

On the other hand, if the decision result in the step S17 is YES, a step S21 decides whether or not the copying operation is completed. The process returns to the step S15 if the decision result in the step S21 is NO, and the copying operation ends if the decision result in the step S21 is YES.

Of course, the present invention is not limited to the application to a copying machine, and may be applied to various image forming apparatuses such as a facsimile machine which use the toner to form images or prints.

In addition, the alarm means for giving an advance notice of the full state of the recovered toner tank 19 to the operator is not limited to the display using the display device 17. For example, the advance notice may be given by sound such as a buzzer or a voice message.

Further, the present invention is not limited to these embodiments, but various variations and modifications may be made without departing from the scope of the present invention.

What is claimed is:

1. A toner recovery system for an image forming apparatus which carries out an image forming operation to form prints of a toner image on a photosensitive body using a toner, said toner recovery system comprising:

toner recovery means for recovering the toner which remains on the photosensitive body after the image forming operation for each print;

a recovered toner tank for accommodating the toner recovered by said toner recovery means;

transport means for transporting the toner recovered by said toner recovery means to said recovered toner tank by moving in a first direction with a first force;

detection means for detecting a movement of said transport means in a second direction which is opposite to said first direction caused by an overflow of the recovered toner in said recovered toner tank; and control means, coupled to said transport means and said detection means, for controlling said transport means to transport the recovered toner by moving in the first direction with a second force which is greater than the first force if said detection means detects the movement of said transport means in the second direction.

2. The toner recovery system as claimed in claim 1, which further comprises:

alarm means, coupled to said control means, for outputting an alarm if said detection means detects the movement of said transport means in the second direction.

3. The toner recovery system as claimed in claim 2, wherein said alarm means includes a display device.

4. The toner recovery system as claimed in claim 1, which further comprises:

counter means, coupled to said control means, for counting a number of prints formed; and stop means, coupled to said control means, for stopping the image forming operation when activated, said control means activating said stop means if said detection means detects the movement of said transport means in the second direction and said counter means thereafter counts up to a predetermined counted value.

5. The toner recovery system as claimed in claim 4, which further comprises:

alarm means, coupled to said control means, for outputting an alarm if said detection means detects the movement of said transport means in the second direction.

6. The toner recovery system as claimed in claim 5, which further comprises:

removal detection means coupled to said control means for detecting removal of said recovered toner tank and for outputting a detection signal, said control means deactivating said stop means and cancelling the movement of said transport means in the first direction with the second force in response to the detection signal if said removal detection means detects the removal of said recovered toner tank, said control means activating said stop means if said detection means detects the movement of said transport means in the second direction in a state where a counted value of said counter means is less than the predetermined counted value, and deactivating said stop means to resume the image forming operation if said detection means detects no movement in the second direction when the counted value in said counter means is the predetermined counted value.

7. The toner recovery system as claimed in claim 4, which further comprises:

removal detection means coupled to said control means for detecting removal of said recovered toner tank and for outputting a detection signal, said control means deactivating said stop means and cancelling the movement of said transport means in the first direction with the second force in response to the detection signal if said removal detection means detects the removal of said recovered toner tank, said control means activating said stop means if said detection means detects the movement of said transport means in the second direction in a state where a counted value of said counter means is less than the predetermined counted value, and deactivating said stop means to resume the image forming operation if said detection means detects no movement in the second direction when the counted value in said counter means is the predetermined counted value.

8. A toner recovery system for an image forming apparatus which carries out an image forming operation to form prints of a toner image on a photosensitive body using a toner, said toner recovery system comprising:

toner recovery means for recovering the toner which remains on the photosensitive body after the image forming operation for each print;

a recovered toner tank for accommodating the toner recovered by said toner recovery means;

transport means for transporting the toner recovered by said toner recovery means to said recovered toner tank by moving in a first direction with a first force;

first detection means for detecting a movement of said transport means in a second direction which is opposite to said first direction caused by an overflow of the recovered toner in said recovered toner tank;

second detection means for detecting the movement of said transport means in the second direction prior to said first detection means;

control means, coupled to said transport means, said first detection means, and said second detection means, for controlling said transport means to transport the recovered toner by moving in the first direction with a second force which is greater than the first force if said first detection means detects the movement of said transport means in the second direction;

said control means increasing the force of said transport means depending on a moving distance of said transport means in the second direction based on the detections of said first and second detection means.

9. The toner recovery system as claimed in claim 8, which further comprises:

alarm means, coupled to said control means, for outputting an alarm if at least said first detection means detects the movement of said transport means in the second direction.

10. The toner recovery system as claimed in claim 9, wherein said control means controls said alarm means to output an alarm in steps depending on the detections of said first and second detection means.

11. A toner recovery system for an image forming apparatus which carries out an image forming operation to form prints of a toner image on a photosensitive body using a toner, said toner recovery system comprising:

toner recovery means for recovering the toner which remains on the photosensitive body after the image forming operation for each print;

a recovered toner tank for accommodating the toner recovered by said toner recovery means;

transport means for transporting the toner recovered by said toner recovery means to said recovered toner tank by moving in a first direction with a first force;

detection means for detecting a movement of said transport means in a second direction which is opposite to said first direction caused by an overflow of the recovered toner in said recovered toner tank;

a counter for counting a predetermined number of prints generated by the image forming apparatus;

an alarm; and control means, coupled to said transport means, said detection means, said counter and said alarm, for controlling said transport means to transport the recovered toner by moving in the first direction, for indicating an alarm when said detection means detects the movement of said transport means in the second direction, for starting the counting means when said detection means detects the movement of said transport means in the second direction, and for stopping operation of the image forming apparatus when said counter reaches said predetermined number.

12. A toner recovery system according to claim 11, wherein said control means prevents said stopping when said detection means no longer detects a movement of said transport means in said second direction.

13. A toner recovery system for an image forming apparatus which carries out an image forming operation to form prints of a toner image on a photosensitive body using a toner, said toner recovery system comprising:

toner recovery means for recovering the toner which remains on the photosensitive body after the image forming apparatus for each print;

a recovered toner tank for accommodating the toner recovered by said toner recovery means;

transport means for transporting the toner recovered by said toner recovery means to said recovered toner tank by moving in a first direction with a first force;

first detection means for detecting a movement of said transport means in a second direction which is opposite to said first direction caused by an overflow of the recovered toner in said recovered toner tank;

second detection means for detecting additional movement of said transport means in the second direction which is beyond the movement detected by the first detection means and which is opposite to said first direction caused by an overflow of the recovered toner in said recovered toner tank;

an alarm; and control means, coupled to said transport means, said first detection means, said second detection means, and said alarm, for activating said alarm when said first detection means detects a movement of said transport means and for stopping said image forming operation of said image forming apparatus when said second detection means detects said additional movement of said transport means.

* * * * *